United States Patent [19]

Schlake et al.

[11] Patent Number: 4,917,318

[45] Date of Patent: Apr. 17, 1990

[54] APPARATUS FOR FABRICATING A LOW VOLTAGE WINDING FOR A TOROIDAL TRANSFORMER

[75] Inventors: Randall L. Schlake, Lexington, Ky.; Clark J. Hamkins, Jackson, Mich.; James D. Richerson, Versailles, Ky.

[73] Assignee: Kuhlman Corporation, Birmingham, Mich.

[21] Appl. No.: 197,061

[22] Filed: May 20, 1988

Related U.S. Application Data

[60] Division of Ser. No. 48,523, May 6, 1987, Pat. No. 4,771,957, which is a continuation of Ser. No. 698,981, Feb. 6, 1985, abandoned.

[51] Int. Cl.[4] ..... H01F 41/06

[52] U.S. Cl. ..... 242/7.09; 242/4 BE; 242/7.15

[58] Field of Search ..... 242/4 B, 4 BE, 4 C, 242/7.07, 7.08, 7.09, 7.11, 7.14, 7.15; 29/605

[56] References Cited

U.S. PATENT DOCUMENTS

| | | | |
|---|---|---|---|
| 2,348,889 | 5/1944 | Earl | 242/4 R |
| 2,406,397 | 8/1946 | Parkinson | 242/7.14 X |
| 2,430,106 | 11/1947 | Conklin | 242/4 B |
| 2,444,126 | 6/1948 | Wirth | 242/4 B |
| 2,657,865 | 11/1953 | Bennert et al. | 242/4 B |
| 2,865,086 | 12/1958 | Whipple | 29/605 |
| 3,383,059 | 5/1968 | Fahrbach . | |
| 3,458,146 | 7/1969 | Warner | 242/4 BE |
| 3,459,385 | 8/1969 | Fahrbach | 242/4 B |
| 3,732,901 | 5/1973 | Kent et al. | 242/4 R |
| 4,007,881 | 2/1977 | Haslau et al. | 242/4 C X |
| 4,269,366 | 5/1981 | Lindenmeyer . | |
| 4,373,680 | 2/1983 | Polge | 242/4 R |
| 4,424,939 | 1/1984 | Ohasi et al. . | |
| 4,467,972 | 8/1984 | Kaiser . | |
| 4,553,705 | 11/1985 | Uchida et al. . | |
| 4,725,009 | 2/1988 | Fahrbach | 242/4 B |

FOREIGN PATENT DOCUMENTS

| | | | |
|---|---|---|---|
| 46453 | 4/1980 | Japan | 242/7.14 |
| 7437 | of 1914 | United Kingdom | 242/4 B |
| 268489 | 4/1927 | United Kingdom | 242/4 B |

*Primary Examiner*—Joseph J. Hail, III

*Attorney, Agent, or Firm*—Townsend and Townsend

[57] ABSTRACT

A winding apparatus for fabricating a multifilar low voltage winding for a toroidal transformer is disclosed. The apparatus uses a wire storage magazine 18 and a wire winding shuttle 20 which rotate about a semitoroidal winding mandrel 38 to wind a multifilar low voltage winding 48 on the winding mandrel having a greater radial depth of turns at the radially inward leg of the winding than at the radially outward leg of the winding. The multifilar winding can be wound with a group of conductors in a single pass over the winding mandrel, or wound one conductor at a time using multiple passes over the winding mandrel, or wound using multiple passes over the winding mandrel with some intermediate number of conductors being wound during each pass.

7 Claims, 10 Drawing Sheets

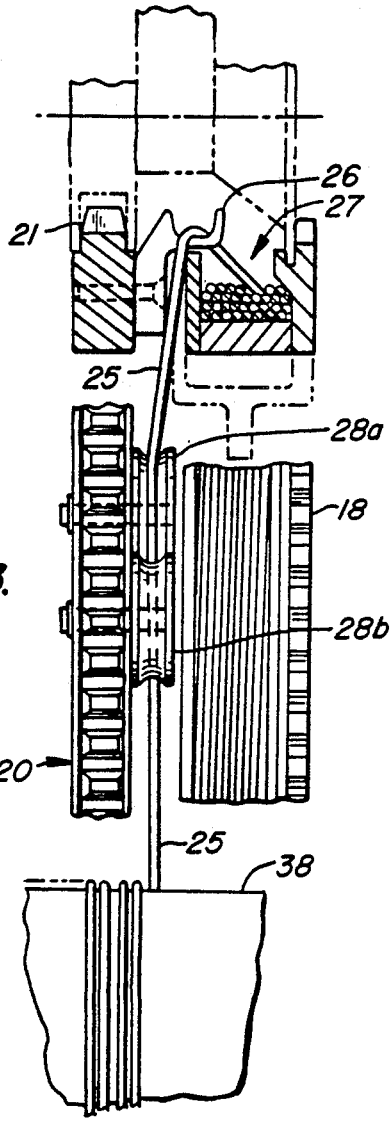
FIG._3.
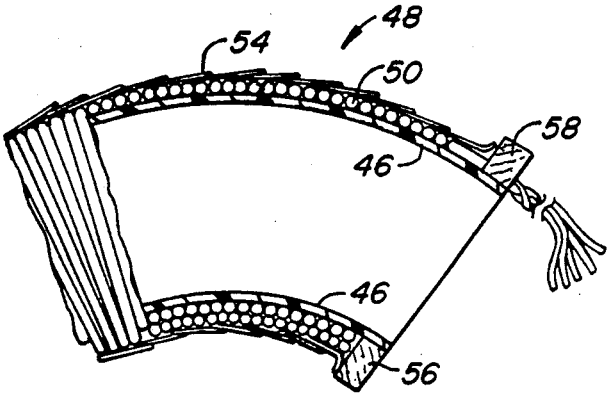
FIG._9.
FIG._10.
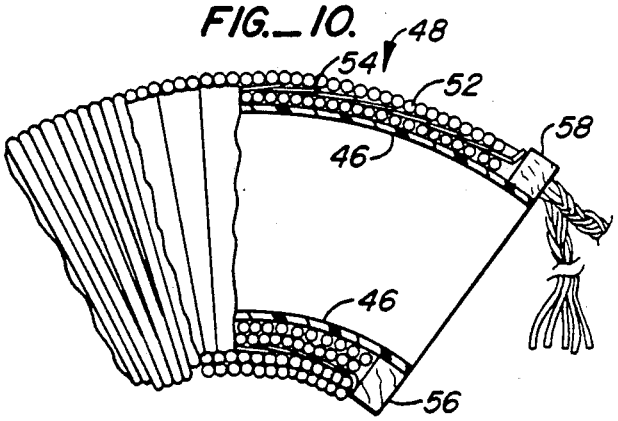
FIG._11.
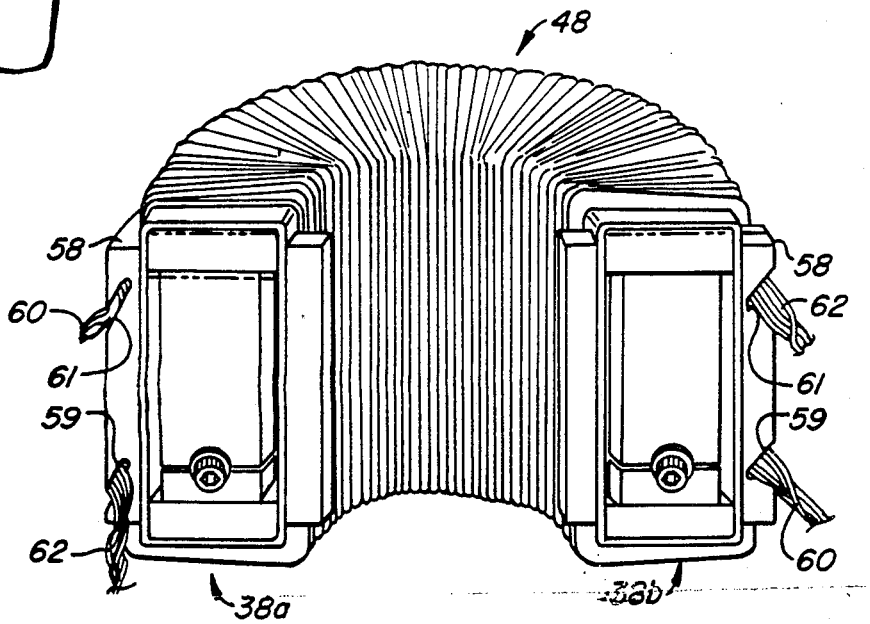

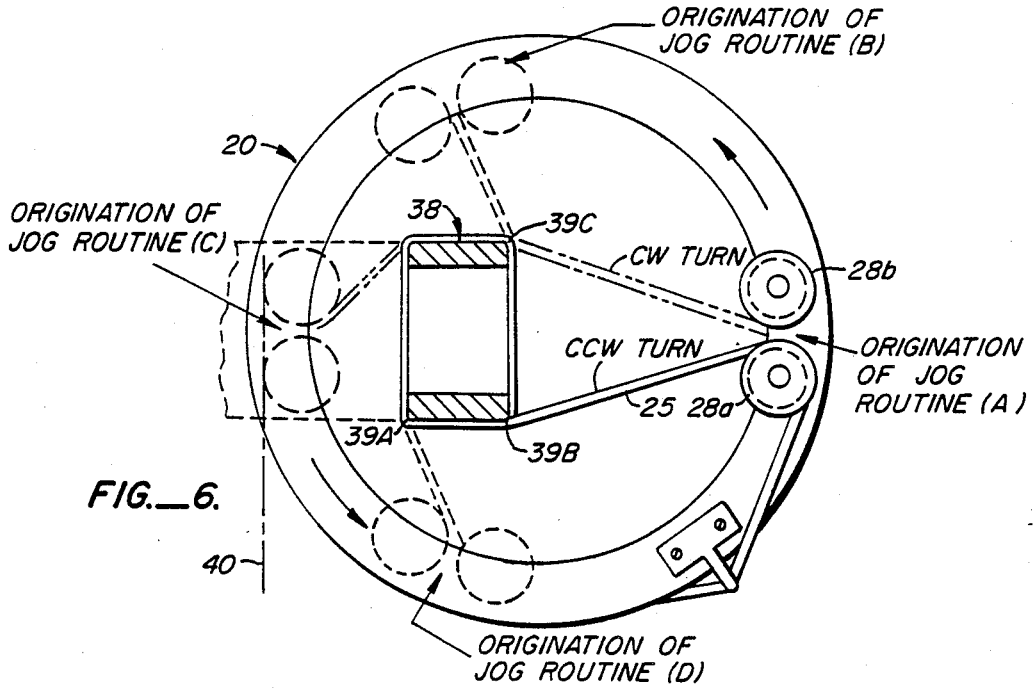
FIG._6.
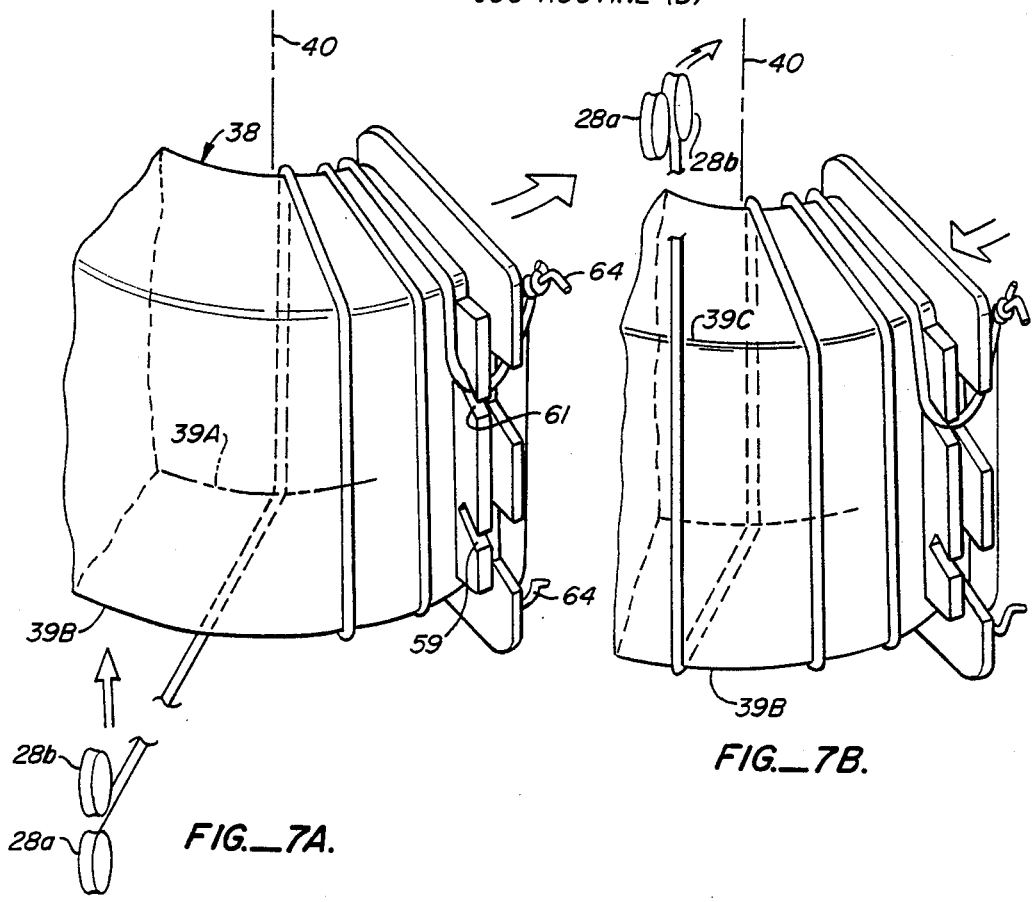
FIG._7A.
FIG._7B.

APPARATUS FOR FABRICATING A LOW VOLTAGE WINDING FOR A TOROIDAL TRANSFORMER

This is a division of application Ser. No. 048,523 filed May 6, 1987, now U.S. Pat. No. 4,771,957, which is a continuation of Ser. No. 698,981 filed Feb. 6, 1985 now abandoned.

BACKGROUND OF THE INVENTION

The present invention constitutes additional inventions over the inventions disclosed in co-pending application, Ser. No. 337,356, filed Jan. 6, 1982, entitled "Toroidal Electrical Transformer and Method for Making Same" now abandoned and the further co-pending applications, Ser. No. 662,312, filed Oct. 17, 1984, entitled "Apparatus and Method for Fabricating a Low Voltage Winding for a Toroidal Transformer," now U.S. Pat. No. 4,665,952 662,467, filed Oct. 17, 1984, entitled "Apparatus and Method for Fabricating a High Voltage Winding for a Toroidal Transformer," now abandoned and 662,330, filed Oct. 17, 1984, entitled "Apparatus and Method for Winding a Magnetic Core for a Toroidal Transformer" now abandoned. The entirety of the disclosures of said co-pending applications are incorporated herein by reference thereto.

Examples of prior art toroidal coil winding machines using rotatable shuttles and magazines are found in the patents to Fahrbach, U.S. Pat. Nos. 3,383,059 and 3,459,385, issued May 14, 1968 and Aug. 5, 1969, respectively. Such machines (hereinafter "Universal Machines") are sold by the Universal Manufacturing Co., Inc., 1168 Grove Street, Irvington, N.J. 07111 under various model numbers.

SUMMARY OF THE INVENTION

In general, this application and the aforementioned co-pending applications are directed to new toroidal transformer designs, and apparatus and methods for manufacturing same, which improve the efficiency of power conversion by a transformer. While the present invention provides similar improvements in efficiency as described in the foregoing co-pending applications, it differs from the inventions of the co-pending applications in a number of significant respects. Particularly, the present invention provides a new multifilar low voltage winding employing round, film insulated, wire conductor and an apparatus and method for fabricating a multifilar low voltage winding for a toroidal transformer. The method and apparatus use a wire storage magazine and a wire winding shuttle which rotate about an arcuate or toroidal winding mandrel to wind a multifilar low voltage winding on the winding mandrel having a greater radial depth of turns at the radially inward leg of the winding than at the radially outward leg of the winding.

While winding machines which wind a toroidal winding using a rotatable winding shuttle and storage magazine passing through the window of a toroidal core are well known in the prior art, as exemplified by the aforementioned Universal Machines, the present invention constitutes a material modification of such Universal Machines and departs from these machines in several important respects. Particularly, the machine and method of the present invention is adapted to wind a toroidally shaped multifilar winding so that the multifilar conductors of the winding are layed side-by-side in a single layer at the radially outward leg of the toroid and are layed in multiple stacked layers at the radially inward leg of the toroid. The multifilar winding can be wound with a group of insulated conductors in a single pass over the winding mandrel, or wound one insulated conductor at a time using multiple passes over the winding mandrel, or wound using multiple passes over the winding mandrel with some intermediate number of insulated conductors being wound during each pass. At the beginning and the end of each pass, an excess length of wire is provided to serve as a lead. When either a single pass or multiple passes are utilized, the excess length of wire which forms the lead can be secured on a hook, peg or the like attached to the winding mandrel. When making multipass windings, the direction of winding is reversed at the end of each pass so that the conductors, when connected in parallel as a multifilar winding, are disposed in the same direction with respect to the magnetic flux path through the core. By connecting the conductors in parallel, each conductor of the completed multifilar winding assumes the same voltage.

Preferably, the low voltage windings are wound upon an arcuate, semitoroidal core insulation tube which is supported and positioned by an expandable mandrel. After one low voltage winding section has been completed, resulting in conductors one layer deep on the radially outward leg of the toroid and two, or more, layers deep on the radially inward leg of the toroid, an insulation barrier is installed about the first winding section, preferably by wrapping an insulating paper about the first winding section. Thereafter, a second section of low voltage winding of similar configuration is wound over the first winding section and the insulation barrier. Subsequent to completion or during the winding of the low voltage windings, the conductor turns are bonded in place. Preferably, one section of the low voltage primary winding is connected to one-half of a 120/240 volt output circuit and the other section of low voltage winding is connected to the other half of the 120/240 volt output circuit. Also, preferably, two arcuate low voltage winding assemblies are used in each transformer with the arcs concentrically arranged to form approximately 330° of a toroidal passage through the low voltage windings. Thereafter, a high voltage winding is assembled onto the low voltage windings and a strip of core material is wound into the arcuate elongated passage within the low voltage windings to form a toroidal transformer having both continuous windings and a continuous core as described in the aforementioned co-pending applications.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

BRIEF DESCRIPTION OF THE DRAWINGS

FIG. 3 is a front elevation view, partially in section, of a wire storage magazine and a shuttle of the winding machine of FIG. 1.

FIG. 6 is a right side elevation view of the shuttle and a section of the winding mandrel taken along line 6—6 of FIG. 4.

FIGS. 7A and 7B are perspective views of the winding mandrel during the winding process.

FIG. 9 is a top plan view partially in section of the winding mandrel after winding a first group of windings.

FIG. 10 is a top plan view partially in section of the winding mandrel after winding a second group of windings.

FIG. 11 is a perspective view of the winding mandrel after completion of the winding process.

DESCRIPTION OF THE PREFERRED EMBODIMENTS

Figure 1:
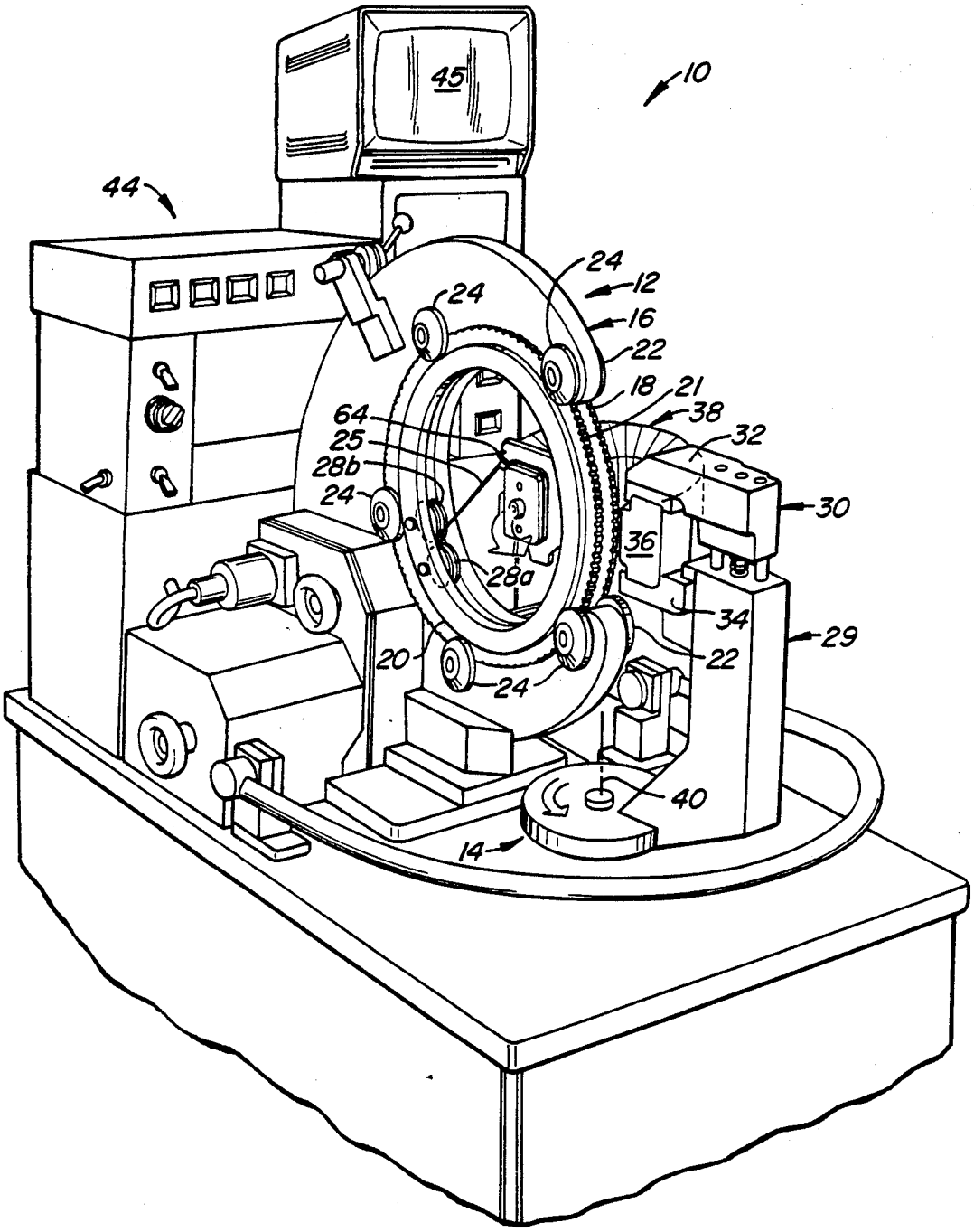
FIG. 1 is a perspective view of a low voltage winding machine according to the present invention.
Figure 2:
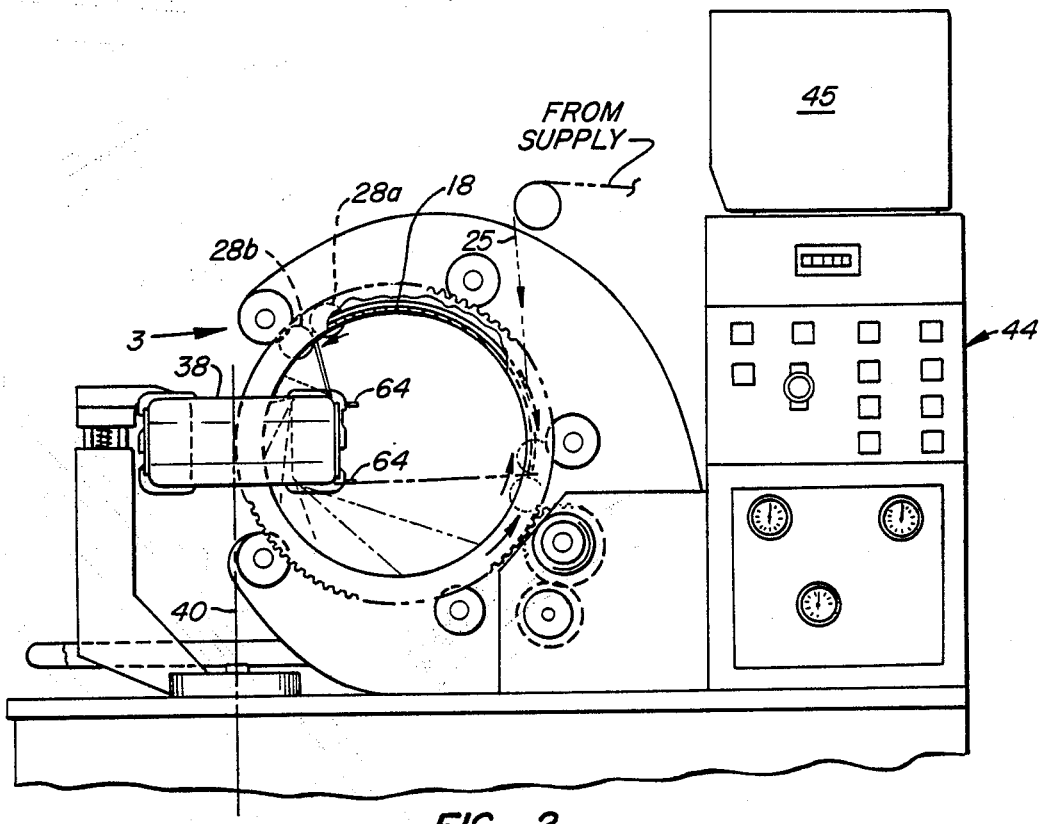
FIG. 2 is a right side elevation view of the winding machine of FIG. 1.

In FIGS. 1 and 2, a first preferred embodiment of a low voltage winding machine 10 of the present invention is illustrated. With the exception of several important modifications, described below, the winding machine 10 is a model "BW" toroidal winding machine manufactured by Universal Manufacturing Co., Inc. of Irvington, N.J., designed along the lines of the machines disclosed in the aforementioned Fahrbach patents.

The winding machine 10 includes a winding head assembly 12 and a rotary table assembly 14. The winding head assembly 12 includes a winding head frame 16 which is generally crescent-shaped as shown to provide a jaw having a circular central opening for containing an annular wire storage magazine 18 and an annular shuttle 20. The wire storage magazine 18 and the shuttle 20 are mounted for independent rotation with respect to the winding head frame 16 by various rotatable mounting wheels 22 and 24, respectively, which are distributed circumferentially about the circular jaw of the winding head frame 16. The wire storage magazine 18 is connected by suitable gears to an air motor which rotatably drives the wire storage magazine 18 about a horizontal winding axis. The shuttle 20 is connected by suitable gears to a numerically controlled electric drive motor which rotatably drives the winding shuttle 20 about the horizontal winding axis independently of the wire storage magazine 18.

The wire storage magazine 18 has an annular U-shaped storage channel 27 (shown in FIG. 3) and can be rotatably driven to wind up a wire 25 from an external bulk supply so that a suitable length of wire may be stored in the storage channel 27 for later forming into a low voltage winding 48 by unwinding the wire 25 from the wire storage magazine 18 and winding the wire 25 onto an arcuate winding mandrel 38. The air motor driving the wire storage magazine 18 is also adapted to provide a braking force which resists the rotation of the wire storage magazine 18 during unwinding of the wire 25 from the wire storage magazine 18. The shuttle 20 is rotatably driven through a circumferential ring gear 21 to unwind wire 25 stored on the wire storage magazine 18 and to wind such wire about the winding mandrel 38. For this purpose, the shuttle 20 is provided with an eyelet 26 (shown in FIG. 3) for lifting wire 25 from the wire storage magazine 18 and a pair of guide wheels 28*a* and 28*b* rotatable about axes parallel to the winding axis for directing the wire 25 onto the winding mandrel 38. Guide wheel 28*a* is used to guide the wire 25 when the shuttle 20 rotates counterclockwise (when viewed from the right side of the machine) as shown in FIG. 2 while the guide wheel 28*b* is used to guide the wire 25 when the shuttle 20 rotates clockwise as shown in phantom in FIG. 6.

The rotary table assembly 14 includes a mandrel support assembly 29, and a mandrel clamp 30 having upper and lower jaws 32 and 34, respectively, for gripping a mounting portion 36 of the winding mandrel 38. The winding mandrel 38 has an arcuate or semitoroidal configuration with the center of the arc or toroid located at the rotational axis 40 of the rotary table assembly 14 such that rotation of the rotary table assembly 14 causes rotation of the arcuate winding mandrel 38 about its axis.

The rotatable table assembly 14 is connected to suitable drive gears and a numerically-controlled motor to provide precise orientation through reciprocal rotation of the winding mandrel 38 under control of an electronic controller 44 during rotation of the shuttle 20 and wire storage magazine 18 to wind conductors onto the winding mandrel 38 in a pre-defined pattern. The various commands to the electronic controller can be displayed on a suitable CRT 45. The controller 44 and CRT 45 are commercially available from Universal Manufacturing Co., Inc.

In the operation of the coil winding machine 10, wire 25 from a bulk source is wound onto the wire storage magazine 18 in a clockwise direction, as viewed in FIG. 2, until a predetermined length of wire 25 suitable for the winding operations to follow is stored in the wire storage magazine 18. Thereafter, the wire 25 from the bulk source is cut. The cut end of wire 25 which has been accumulated on the wire storage magazine 18 is secured to a hook or peg 64 fixedly mounted to one end of the winding mandrel 38 to provide a start lead prior to winding. As illustrated in FIG. 3, wire 25 is removed from the wire storage magazine 18 by the rotation of the shuttle 20 and is wound onto the winding mandrel 38 through guide wheel 28*a* or 28*b*, depending on the direction of rotation, as the shuttle 20 rotates. Eyelet 26 serves to lift the wire 25 from the storage channel 27 of the wire storage magazine 18 and to guide the wire 25 to the guide wheels 28*a* and 28*b*. Since the effective winding diameter of the winding mandrel 38 is substantially less than the diameter of the wire storage magazine 18, the wire storage magazine 18 is allowed to rotate independently of the shuttle 20 to accommodate the speed differential caused by the difference in such diameters.

During the winding of wire 25 onto the winding mandrel 38 by rotation of the shuttle 20 and the wire storage magazine 18, the winding mandrel 38 is rotated about its axis of revolution 40 to lay the wire 25 on the winding mandrel 38 in a predetermined pattern.

Figure 4:
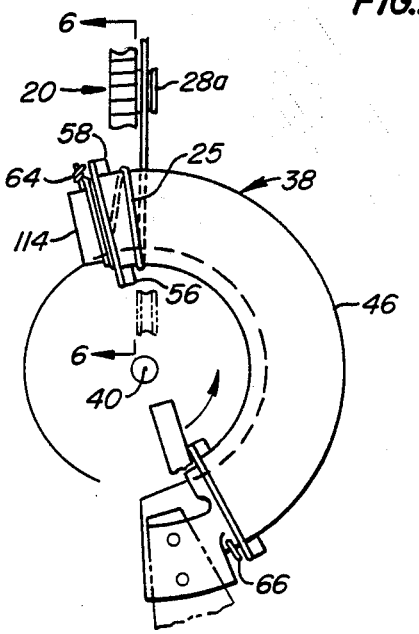
FIG. 4 is a top plan view of a winding mandrel at the initiation of a winding process.
Figure 5:
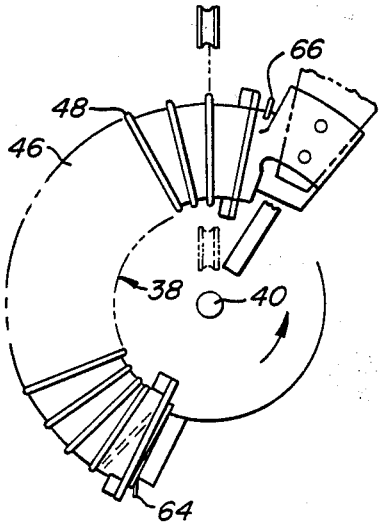
FIG. 5 is a top plan view of the winding mandrel at a later point in the winding process.

With regard to FIGS. 4 and 5, the winding pattern of a winding pass over the winding mandrel 38 is illustrated. Note that the winding begins at the upper portion of the winding mandrel 38 as shown in FIG. 4 and progresses as the winding mandrel 38 rotates in an overall counterclockwise direction about axis 40. During such counterclockwise rotation of the winding mandrel 38 about axis 40, the shuttle 20 and wire storage magazine 18 rotate counterclockwise (relative to the view of FIG. 2) about the horizontal winding axis to wind the wire 25 onto the winding mandrel 38. During such winding, the winding mandrel 38 also accomplishes certain reciprocal "jogging" motions, i.e., back and forth rotations about axis 40, under the control of the controller 44 to lay the wire in a predetermined pattern, an example of which is illustrated in FIG. 5. The overall sum of the clockwise and counterclockwise reciprocal rotations of the winding mandrel 38 about axis 40 is a counterclockwise rotation from the view of FIG. 4 to the view of FIG. 5. Whereas a continuous rotation of the winding mandrel 38 would result in the fabrication of a spiral winding, the preferred reciprocal jogging motion of the winding mandrel 38 facilitates the fabrication on a non-spiral winding.

In FIGS. 8A–8E, the winding sequence for five conductors of a five-strand multifilar low voltage winding 48 is illustrated. Note that the single strand is wound successively in each of five passes to provide the five-strand multifilar winding. Prior to winding, the core insulation tube 46 is placed on the winding mandrel 38 as described in detail hereinafter.

Figure 8A:
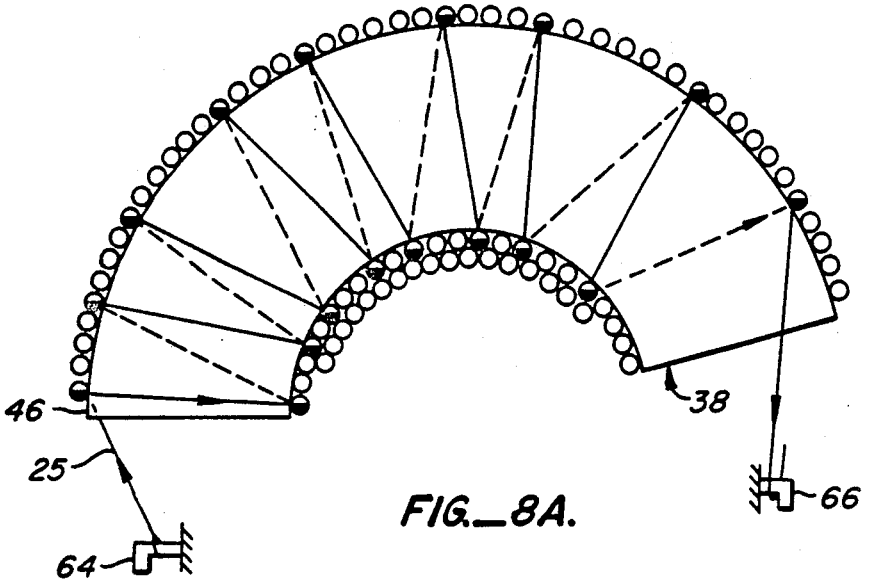
FIGS. 8A–8E are diagrammatic top plan views of the winding mandrel illustrating winding patterns for a multipass single-strand winding method for manufacturing a multifilar winding.

In the first pass, illustrated schematically in FIG. 8A, a single wire 25 is first secured to post 64 and a turn is wound on end plate 114 (FIG. 12) of the winding mandrel 38 to provide an excess length of conductor which serves as a start lead of the coil winding. The wire 25 is then led onto the core insulation tube 46 and the first pass is wound by counterclockwise rotation of the shuttle 20. The solid transverse lines in FIG. 8A represent the turns wound across the top of the winding mandrel 38, while the dashed transverse lines represent the turns wound across the bottom of the winding mandrel 38. At the completion of the first winding pass, an excess length of conductor is extended outwardly from the winding mandrel 38 to subsequently serve as a finish lead and is looped about a second post 66. To distinguish the turns of the first winding pass from the turns of the subsequent winding passes, each cross-section of the wire 25 at the radially inward and radially outward legs is designated by a small circle containing a darkened half sector.

Figure 8B:
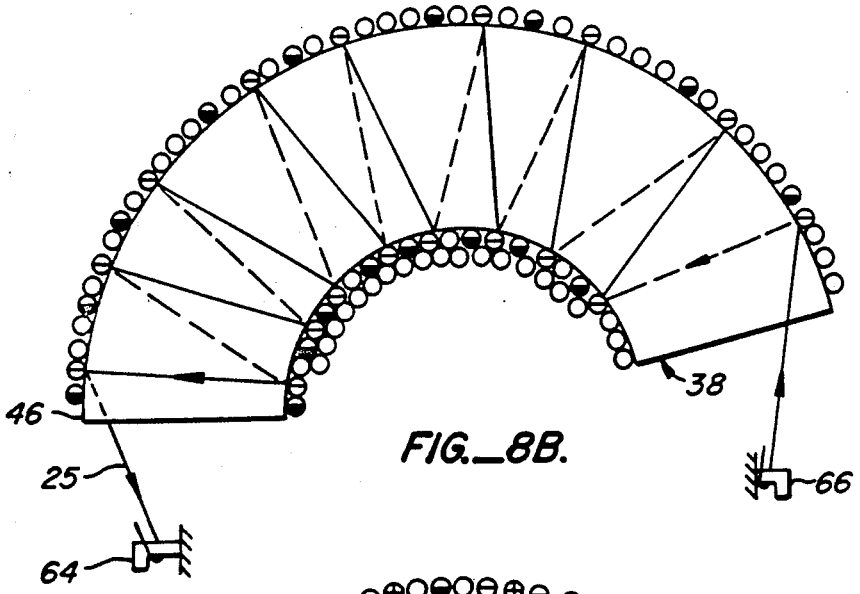

Thereafter, a second winding pass is reverse wound (i.e., with the shuttle 20 rotating clockwise) in spaced groups of turns, as schematically illustrated in FIG. 8B by solid and dashed transverse lines and identified by small circles with a single horizontal line. At the completion of the second pass, an excess length of conductor is extended outwardly from the winding mandrel 38 to provide a start lead for the winding and is looped about the first post 64. The turns of the first two winding passes are inter-leaved in a single layer against the core insulation tube 46.

Figure 8C:
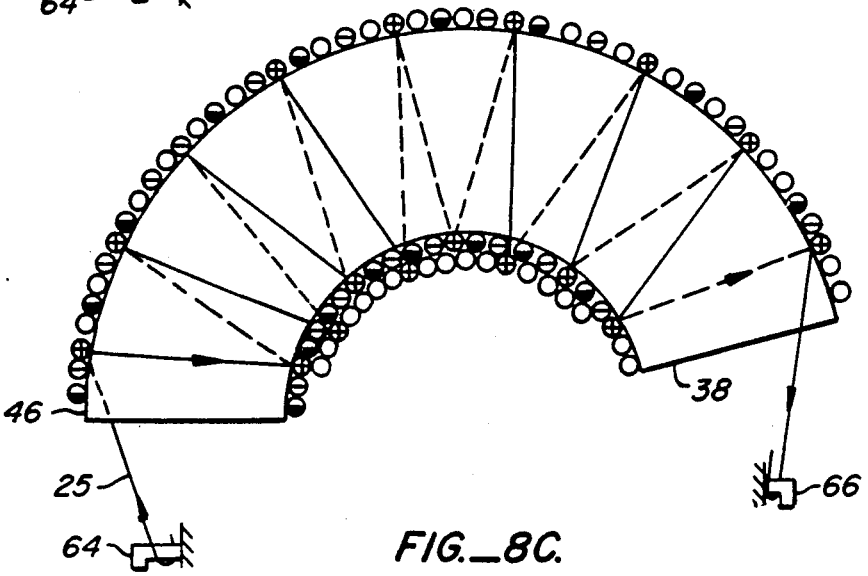

In FIG. 8C, a third winding pass is illustrated schematically, again by solid and dashed transverse lines. In the third winding pass, the wire 25 is wound with the shuttle 20 turning counterclockwise and is designated by a small circle containing two crossed lines. In the third winding pass, each turn is approximately evenly spaced. On the outside leg of the toroid, the turns lay against the core insulation tube 46. At the inside leg of the toroid, however, the turns lay in part in the first layer against the core insulation tube 46 and lay in part in a second, radially inward layer, approximately in equal proportion. In other words, two and a half windings are required to complete the inner layer of the radially inward leg of the toroidal winding. At the completion of the third pass, an excess length of wire 25 is again extended outwardly and looped around the second post 66 to provide a finish lead for the winding.

Figure 8D:
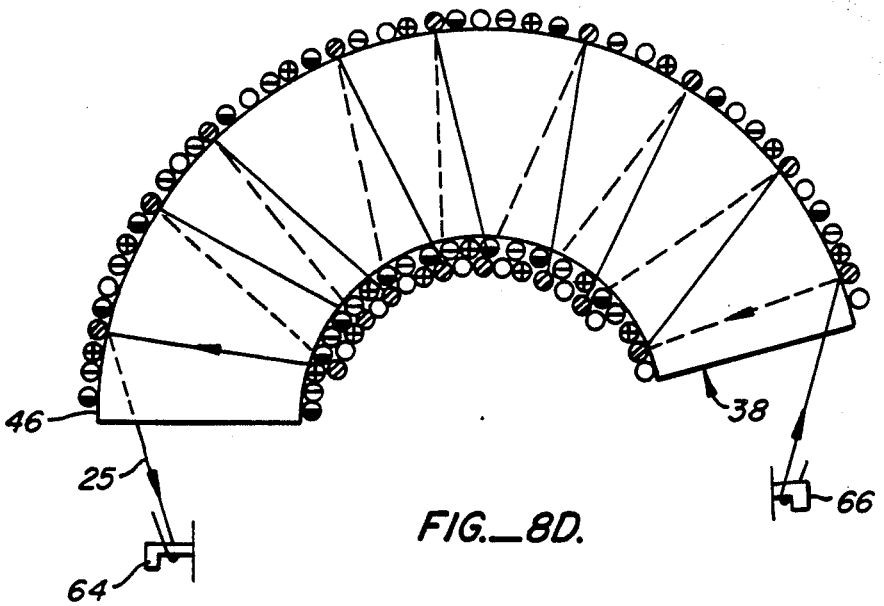

In FIG. 8D, the winding of a fourth pass is schematically illustrated, which is wound with the shuttle 20 turning clockwise. The path of the fourth winding is illustrated by the solid and dashed transverse lines and by small circles containing two parallel lines. Again, at the radially outward leg of the toroid, the turns lie in the first layer against the core insulation tube 46, while at the radially inward leg of the toroid, the turns lie in the second layer. Again, the pass is completed by extending the conductor outwardly and looping around post 64 to form a start lead.

Figure 8E:
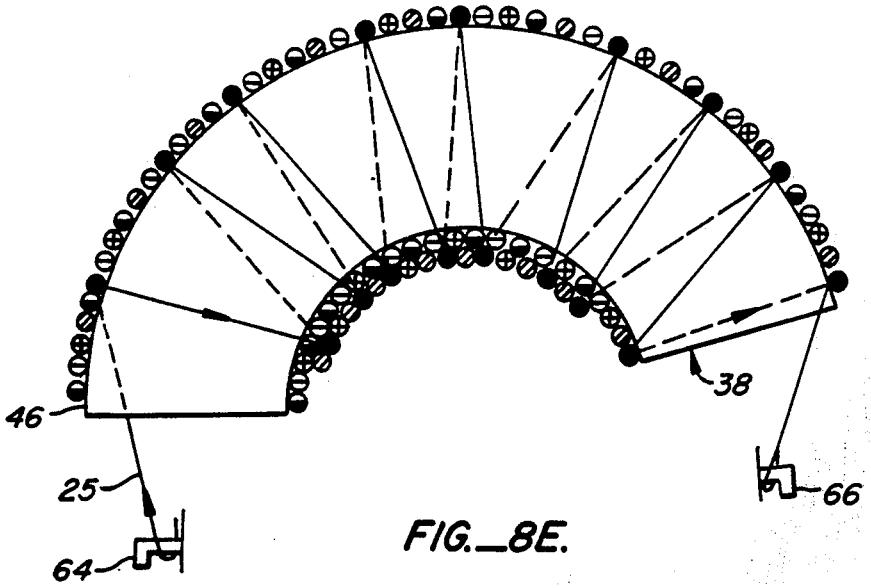

A final winding pass that completes a low voltage winding section is schematically illustrated in FIG. 8E. The turns are again wound with the shuttle 20 turning counterclockwise with each turn filling in gaps left by the previous winding passes. The path of the fifth winding pass is illustrated by solid and dashed transverse lines and by small darkened circles. The final pass substantially fills the available space in the first layer of the radially outward leg and substantially fills the space in the second layer of the radially inward leg. At the completion of the fifth winding pass, a finish lead is extended outwardly and looped around the post 66. Thereafter, all winding pass leads at post 64 are joined in common and all winding pass leads at post 66 are joined in common to form the multifilar winding.

As an alternative to the five pass winding method illustrated in FIGS. 8A–8E, the winding process can be performed in fewer passes than the number of multifilar conductors by winding more than one conductor at a time. On the first pass, two or more wires are wound around the winding mandrel 38 by rotating the shuttle 20 in one direction about the winding axis and by rotating the winding mandrel about the mandrel axis 40 according to its reciprocal jogging motion, with each turn of the two or more wires being placed side by side at the radially inward surface of the winding mandrel 38 and being circumferentially spaced apart from adjacent turns at the radially outward surface of the winding mandrel 38. On the second pass, the two or more wires are wound around the winding mandrel 38 by rotating the shuttle 20 in the other direction about the winding axis and rotating the winding mandrel 38 about the mandrel axis 40 in a reverse reciprocal jogging motion, with each turn of the two or more wires of the second pass being stacked upon the turns of the first pass at the radially inward surface of the winding mandrel 38 and being placed between adjacent turns of the first pass at the radially outward surface of the winding mandrel 38.

The windings of the low voltage winding 48 are preferably not spiral. Rather, the turns have axially oriented (with respect to the axis 40) segments at the radially inward and outward legs of the winding with generally radial or non-radial transitions on the top and bottom legs of the winding. The positions of the turns at the radially inward and outward legs are defined by the winding pattern shown in FIGS. 8A–8E. The positions of the turns across the top and bottom legs are defined by the positions of the connecting inward and outward legs. This positioning is accomplished using jog routines illustrated in FIGS. 6, 7A and 7B.

The shuttle 20 rotates in a stationary vertical plane, which passes through the mandrel axis 40, while the winding mandrel 38 oscillates or jogs clockwise and counterclockwise about its axis 40 to position the wire 25 on the winding mandrel 38. The four jog positions, A through D, are illustrated in FIG. 6 and are provided in the program commercially available with the Universal machine, while the results of the jogs are exemplified in FIGS. 7A and 7B. In the disclosed embodiment, the jog positions A–D remain the same for both clockwise and counterclockwise rotation of the shuttle 20, but can be modified to provide four jog positions for each winding direction with the correlative jog positions for each winding direction somewhat offset with respect to the other.

An understanding of the jog routines is not necessary for a full understanding of the present invention and such routines may be varied as suits the designer. In essence, in order to wind the wire non-spirally, the winding mandrel 38 is jogged clockwise and counterclockwise about the axis 40 as illustrated in FIGS. 7A and 7B. In order to position the wire 25 to traverse across one leg of the winding, the winding mandrel 38 rotates clockwise or counterclockwise about axis 40 in jog routine A-D after the wire has contacted one edge of the winding mandrel 38 and prior to the wire 25 contacting the next edge of the winding mandrel 38, e.g. edges 39A and 39B for jog routine D, to project the wire 25 in the non-spiral direction as shown in FIG. 7A. As the shuttle 20 continues to rotate counterclockwise about its axis, the wire 25 contacts the outward lower edge 39B of the winding mandrel 38 to position the wire 25 across the bottom surface of the winding mandrel 38, which ends jog routine D. The routines of clockwise and counterclockwise jogs continue as the shuttle 20 rotates around the winding mandrel 38 to wind the wire 25 onto the winding mandrel 38 so as to provide axially oriented inside and outside legs and connecting top and bottom legs in the pattern illustrated in FIGS. 8A–8E.

In general, the position of the wire 25 as it is wound over each edge of the winding mandrel 38 is determined by the position of a previously wound edge of the winding mandrel 38 relative to the guide wheels 28 of the shuttle 20. The wire 25 forms a straight line between the previously wound edge of the winding mandrel 38 and the guide wheels 28. As the shuttle 20 rotates, an adjacent edge of the winding mandrel 38 contacts the wire 25 at an intermediate point along the straight line between the previously wound edge and the guide wheels 28, thus defining the position of the wire 25 between those two edges. The purpose of each jog routine is to rotate the winding mandrel 38 to a position to correctly place the wire 25 at each edge of the winding mandrel 38, with the edge placements determined by the winding sequence illustrated in FIGS. 8A–8E.

With reference to FIGS. 9 and 10, a molded paperboard core insulation tube 46 is seen which is mounted on the winding mandrel 38 during winding of the low voltage winding 48. The low voltage winding 48 includes an inner winding group or section 50 and an outer winding group or section 52 (the latter shown only in FIG. 10) which are separated by an insulation barrier 54. The core insulation tube 46 is configured to surround the wound magnetic core of the transformer, and accordingly, is arcuate in cross-section and is adapted to be concentrically arranged with a second such tube to form a toroidal core passage of approximately 330°. Each end of the core insulation tube 46 carries a pair of end blocks 56 and 58, with block 58 being positioned on the radially outward leg of the core insulation tube 46, and with block 56 being positioned on the radially inward leg of the core insulation tube 46. The radially outward blocks 58 have slanted slots 59 and 61 as illustrated in FIG. 11 to position and retain the leads 60 of the inner winding section 50 and the leads 62 of the outer winding section 52. The start leads 60 of the inner winding section 50 extend from the start end 38A of the winding mandrel 38 and are secured by the upper slot 61 in ed block 58. The finish leads 60 of inner winding section 50 extend from the finish end 38B of the winding mandrel 38 and are secured in the lower slot 59 in end block 58. Similarly, leads 62 of the outer winding section 52 are secured by starting and finishing the winding with leads placed in the remaining alternate slots 59 and 61, respectively. Placement of the low voltage winding leads in the above manner results in a reversible semitoroidal winding in which the leads emerge from the same relative locations and the proper winding direction is maintained regardless of the orientation in which the coil is installed in the completed transformer.

With reference to FIG. 9, the results of the winding of the inner section 50 of the multifilar low voltage winding 48 are illustrated. Note that the inner section 50 has a single layer of conductors on the radially outward leg of the toroid and a double layer of conductors on the radially inward leg of the toroid. Additionally, in FIG. 9, the insulation barrier 54 is seen to comprise insulation material, preferably a crepe paper strip, wrapped about the inner winding section 50 of the low voltage winding 48. Note that adjacent wraps of the crepe paper substantially overlap to provide at least a single layer of crepe paper over the radially outward leg of the inner winding section 50. After the insulation barrier 54 is wound over the inner winding section 50, the outer low voltage winding section 52 is wound as illustrated in FIG. 10. Note that the outer winding section 52 is wound in the same fashion as the inner winding section 50 with a single layer of conductors at the radially outward leg of the toroid and a double layer of conductors at the radially inward leg of the toroid. Either subsequent to completion or during the winding of the low voltage winding 48, the conductor turns are bonded into place preferably by use of an adhesive, dry to the touch, B-stage thermosetting conductor coating which is activated by a baking process following winding or, alternatively, by wet application of a thermosetting adhesive during the winding process.

Figure 12:
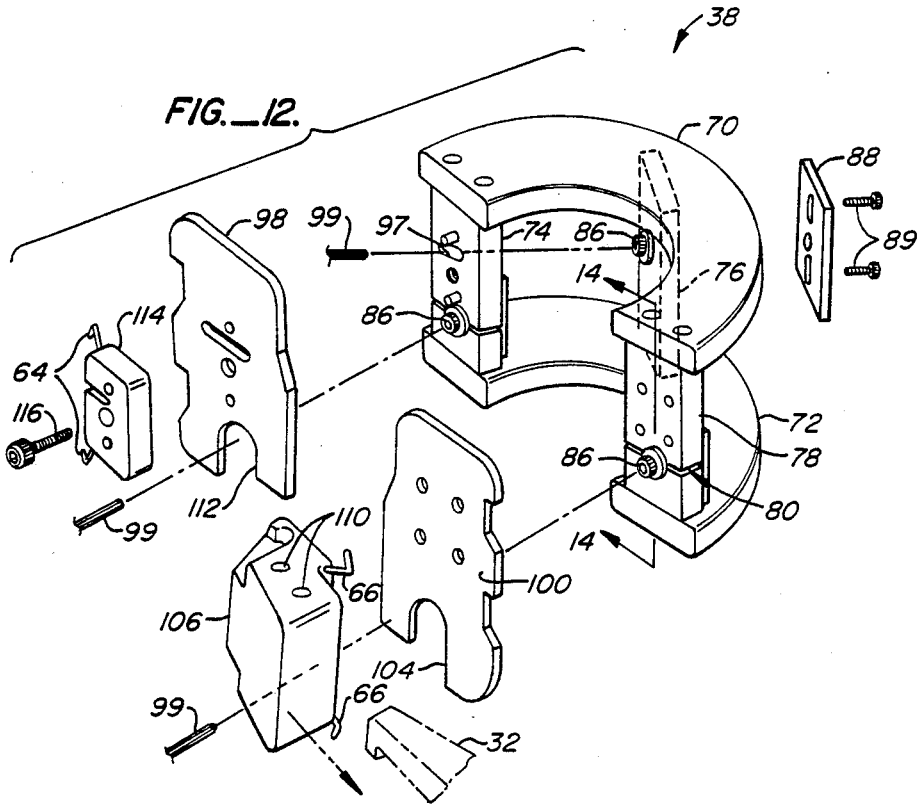
FIG. 12 is an exploded perspective view of the expandable winding mandrel.
Figure 14:
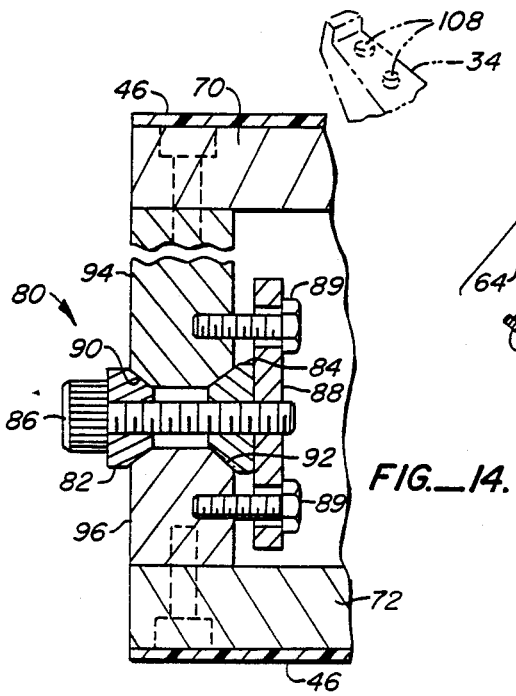
FIG. 14 is a sectional detail view of a cross support of the winding mandrel, and is taken along the line 14—14 of FIG. 12.

With reference now to FIG. 12, the winding mandrel 38 is illustrated in an exploded perspective view. The winding mandrel 38 includes upper and lower arcuate support plates 70 and 72, respectively, which are joined by three expandable cross supports 74, 76, and 78. Each cross support 74, 76, and 78 includes an expandable joint 80 which, for example, can include a pair of conical washers 82 and 84 residing on a compression bolt 86 which is threaded into a compression plate 88, as shown in FIG. 14. The compression plate 88 is mounted for movement along guide bolts 89. The conical washers 82 and 84 bear inwardly against conical cam surfaces 90 and 92 on upper and lower support members 94 and 96, respectively, of the cross support. Rotation of the compression bolt 86 to draw the conical washers 82 and 84 together acts to bias the support members 94 and 96 apart thereby spreading apart the upper and lower arcuate support plates 70 and 72. Cross support 74 is provided with an opening 97 (FIG. 12) to permit access of a tool 99 to the head of the compression bolt 86. The tool 99 mates with the heads of each compression bolt 86 of the three expandable cross supports 74, 76, and 78 to rotate the bolt 86 for expanding and contracting the mandrel 38.

By expanding the mandrel 38, the upper and lower arcuate support plates 70 and 72 can be brought to forcibly bear against the inner upper and lower surfaces and corners of the core insulation tube 46 to hold the core insulation tube 46 firmly in relation to the winding mandrel 38 and to prevent collapse or deformation of the core insulation tube 46 during winding of the low voltage winding 48. In this regard, winding of the low voltage winding 48 occurs under a significant winding tension which tends to cause the molded paperboard structure of the core insulation tube 46 to collapse or deform prior to bonding in subsequent processes if not firmly supported. Of course, insulation tubes of more substantial construction can be made at somewhat higher costs to avoid such deformation. However, the expandable mandrel 38 provides a ready means for detachably mounting the core insulation tube 46 during winding while at the same time providing structural support. Additionally, by collapsing the support plates 70 and 72 inward, the completed low voltage winding 48 can be readily removed from the winding mandrel 38.

End plates 98 and 100 are secured to the ends of the expandable winding mandrel 38 to hold the insulation tube 46 in position on the winding mandrel 38. End plate 100 is permanently secured to the cross support 78 and is provided with a slot 104 for access of the tool 99 to the head of compression bolt 86 as shown in FIG. 12. The end plate 100 also carries a mounting stem 106 which is rigidly fixed to the mounting plate 100 and cross support 78 and is configured to mate securely with the jaws 32 and 34 of the mandrel clamp 30. For this purpose, jaws 32 and 34 are provided with pins 108 while the mounting stem 106 is provided with corresponding recesses 110.

Figure 13:
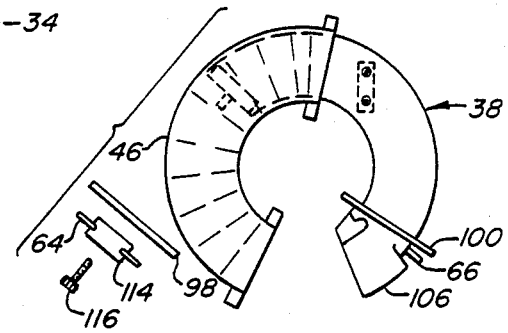
FIG. 13 is a top plan view of the winding mandrel illustrating the loading and unloading of a core insulation tube.

End plate 98 is adapted to be removably secured to cross support 74 to facilitate mounting and removal of the core insulation tube 46. End plate 98 has a slot 112 which permits access of the tool 99 to the head of the bolt 86 for expanding and contracting cross support 74. End plate 98 also carries a pin mounting block 114 which is normally removed along with the end plate 98. A threaded fastener 116 is used to removably secure the pin mounting block 114 and the end plate 98 to the cross support 74. As illustrated in FIG. 13, the plate 98 with its attached winding pin mounting block 114 is removable upon removal of threaded fastener 116 whereby the insulation barrier 46 may be inserted onto the winding mandrel 38, and after winding, likewise removed. The pin mounting block 114 carries the winding pegs 64 while the mounting stem 106 carries the winding pegs 66.

Figure 15:
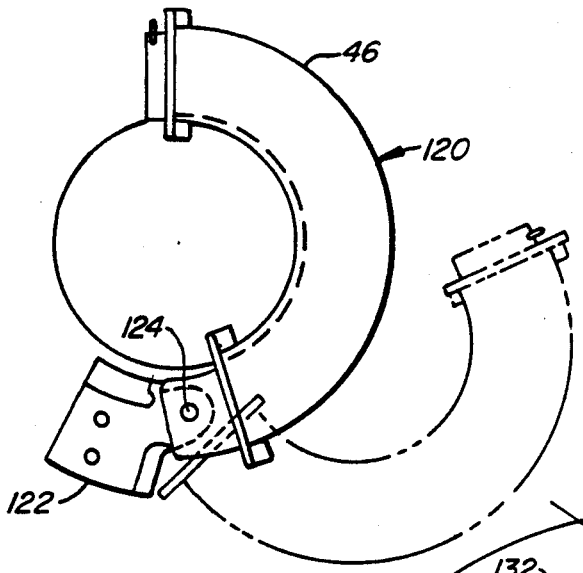
FIG. 15 is a top plan view of an alternative embodiment of a winding mandrel.

In FIG. 15, an alternative winding mandrel 120 is illustrated. The winding mandrel 120 differs from the winding mandrel 38 in that it is pivotedly mounted to the mounting stem 122 using a hinge 124 whereby the portion of the winding mandrel 120 carrying the core insulation tube 46 can be rotated with respect to the mounting stem 122 to facilitate easy mounting and removal of the core insulation tube 46 before and after winding of the low voltage winding 48. Particularly, the hinge 124 facilitates removal of the core insulation tube 46 since the core insulation tube 46 must be removed from the winding mandrel 38 in a circular motion until it is free from the winding mandrel 38. Due to the length of the core insulation tube 46, it does not become free of the winding mandrel 38 until it is in close proximity to the mounting stem 106 providing little clearance for insertion and removal of the core insulation tube 46. The use of a hinged connection with the mounting stem 122 significantly increases the clearance for removal of the core insulation tube 46 by allowing outward hinging of the portion of mandrel 120 which carries the core insulation tube 46.

Figure 16:
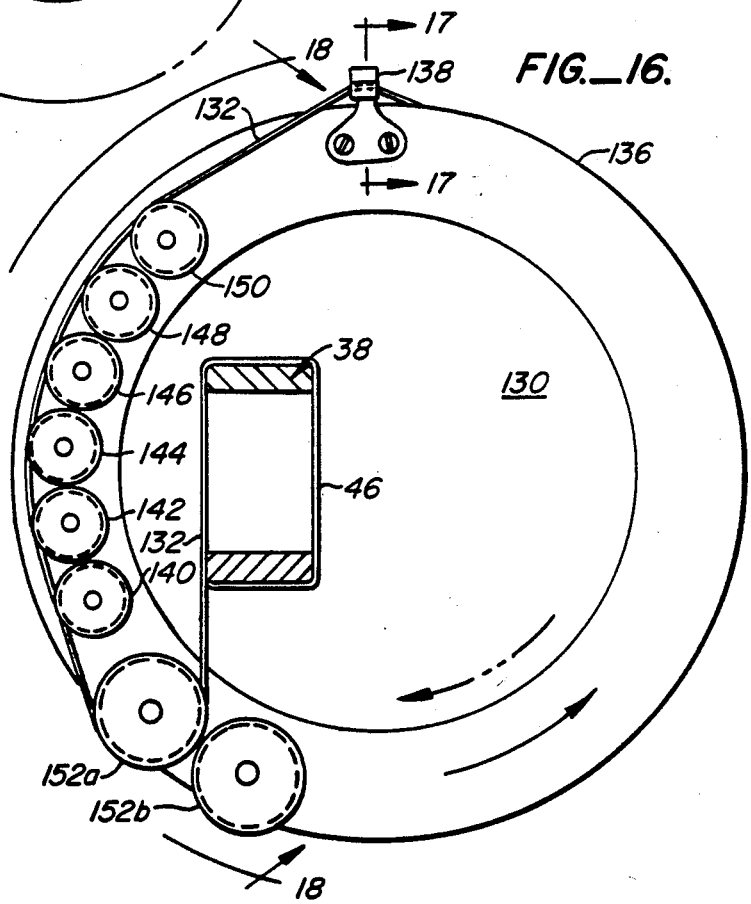
FIG. 16 is a right side elevation view of an alternative embodiment of the shuttle.
Figure 17:
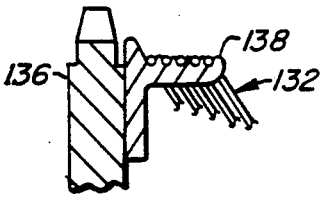
FIG. 17 is a sectional detail view of a portion of the shuttle of FIG. 16, and is taken along the line 17—17 of FIG. 16.
Figure 18:
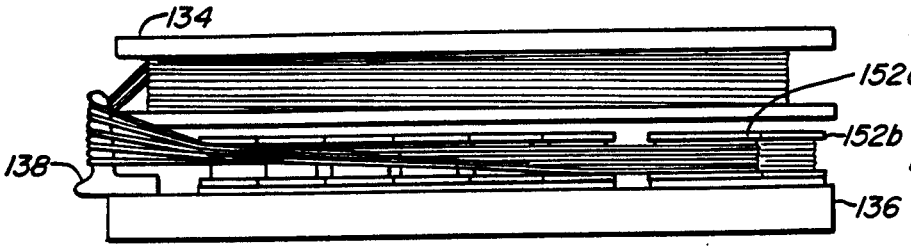
FIG. 18 is a view of the shuttle of FIG. 16 and a wire storage magazine and is viewed from the perspective of arrow 18 of FIG. 16.

In FIGS. 16, 17, and 18 a second low voltage coil winding machine 130 according to the present invention is illustrated. The low voltage coil winding machine 130 is adapted to wind a multifilar low voltage winding in a single pass. To facilitate a multifilar, single-pass winding, multiple strands of a multifilar conductor 132 are simultaneously wound onto the storage magazine 134 from a source of multifilar conductor or from multiple separate sources of a single conductor. After clockwise winding of the multiple strands of conductor 132 onto the storage magazine 134, the shuttle 136 and the storage magazine 134 are rotated counterclockwise to wind the multifilar conductor 132 on the core insulation tube 46 as illustrated in FIGS. 19A–19E. As the shuttle 136 rotates counterclockwise, the multiple strand multifilar conductor 132 is lifted and unwound from the storage magazine 134 by multifilar eyelet 138. To facilitate this purpose, the multifilar eyelet 138 has multiple guide grooves, one for each strand of the multifilar wind conductor 132.

The shuttle 136 is provided with a plurality of wire tensioning wheels 140–150, each having a groove about its periphery. Each strand of the multifilar conductor 132 is separately wrapped around at least one of the tensioning pulleys 140–150. The remaining strands of multifilar conductor 132 ride over the tops of the other tensioning pulleys. Accordingly, each tensioning pulley 140–150 serves to tension a single strand independently of the other strands. However, more than one tensioning pulley may, in some cases, be required to adequately tension a single strand. This independent tensioning of each of the strands of the multifilar conductor 132 accommodates any unevenness in the build of the strands of the multifilar conductor 132 either on the storage magazine 134 or on the core insulating tube 46 mounted on the winding mandrel 38.

To provide multifilar single pass coil winding in the counterclockwise direction, a guide wheel 152*a* is utilized having a groove for each of the strands of the multifilar conductor 132. The multifilar conductor 132, after traversing the guide wheel 152*a* is wound upon the core insulation tube 46 as the shuttle 136 and the storage magazine 134 rotate counterclockwise. An adjacent guide wheel 152*b*, also having a groove for each of the strands of the multifilar conductor 132, may be employed to wind in the clockwise direction.

In FIGS. 19A through 19E, a preferred method and pattern of laying the multifilar conductor 132 in a single pass is illustrated. Multiple conductors 132 are simultaneously wound onto the winding mandrel 38 to form one layer of the low voltage winding 48 in a single pass, with the multiple conductors laying side by side in a single layer at the radially outward surface of the winding mandrel 38 and laying stacked in a double layer at the radially inward surface of the winding mandrel 38. Briefly, this method involves laying one or more first type turns with the multiple conductors wound around and contacting the winding mandrel 38, then winding a second type turn with the multiple conductors positioned side by side to previous first type turns at the radially outward surface of the winding mandrel 38 and stacked upon portions of one or more first type turns at the radially inward surface of the winding mandrel 38, then alternately winding the first and second type turns until the set of windings is completed.

Figure 19A:
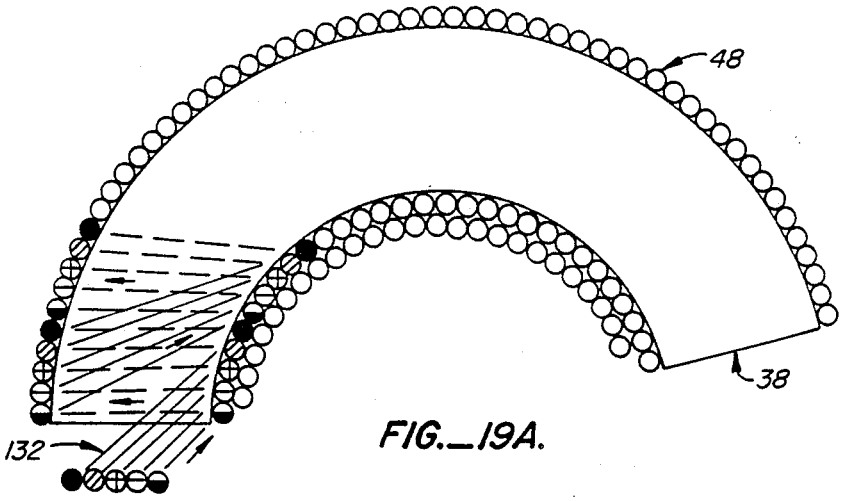
FIGS. 19A–19E are diagrammatic top plan views of the winding mandrel illustrating the winding pattern for a single pass multiconductor winding method for fabricating a multifilar winding.

As shown in FIG. 19A, the first step in the method of winding the multifilar conductor 132 in a single pass involves winding a few first type turns with all of the multiple conductors 132 laying side by side against the core insulation tube 46 on the winding mandrel 38. The multiple conductors 132, illustrated as comprising five conductors, are preferably wound onto the winding mandrel 38 in the same manner as described above, namely, by rotating the shuttle 136 in the counterclockwise direction (as viewed in FIG. 16) around its horizontal winding axis while rotating the winding mandrel 38 about the mandrel axis 40 in a reciprocal jogging motion to place the conductors axially with respect to the mandrel axis 40 at the radially inward and radially outward surfaces of the winding mandrel 38 and across the top and bottom surfaces of the winding mandrel 38. Two such first type turns are illustrated in FIG. 19A.

Figure 19B:
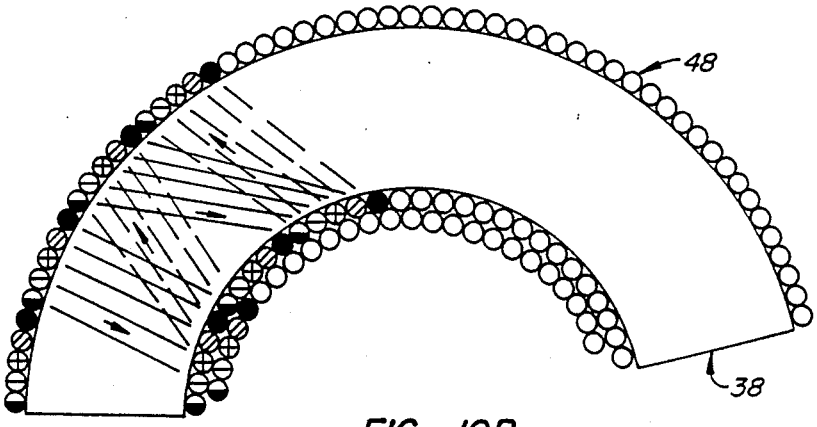
Figure 19C:
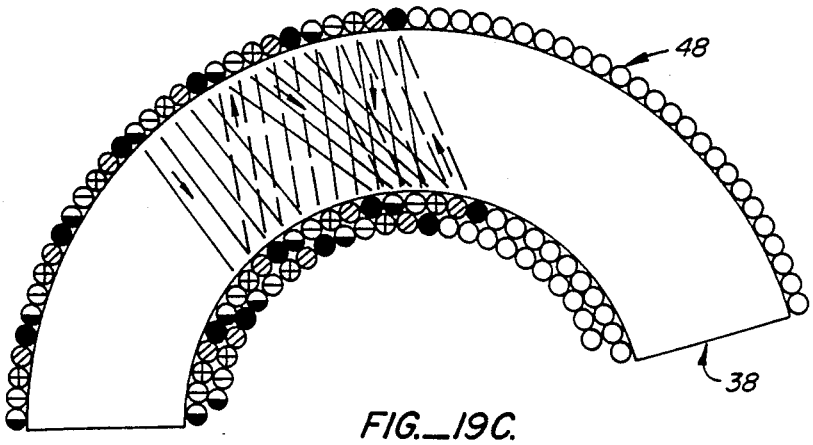
Figure 19D:
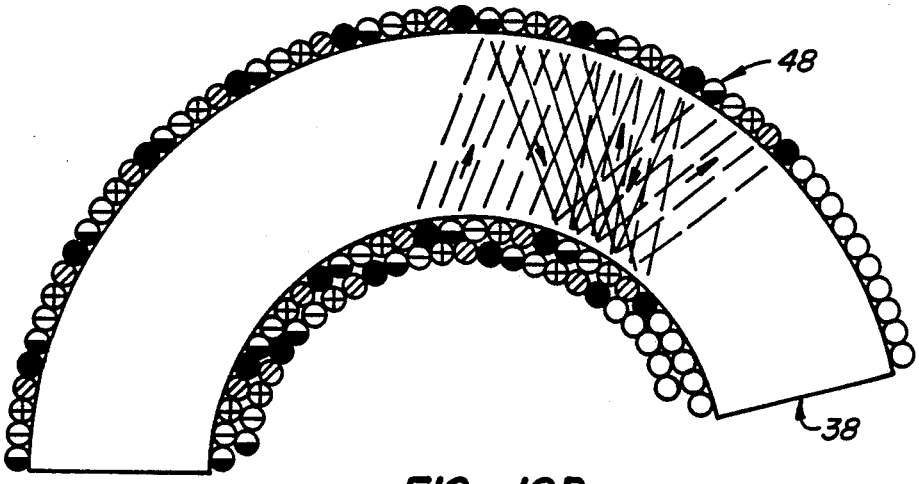
Figure 19E:
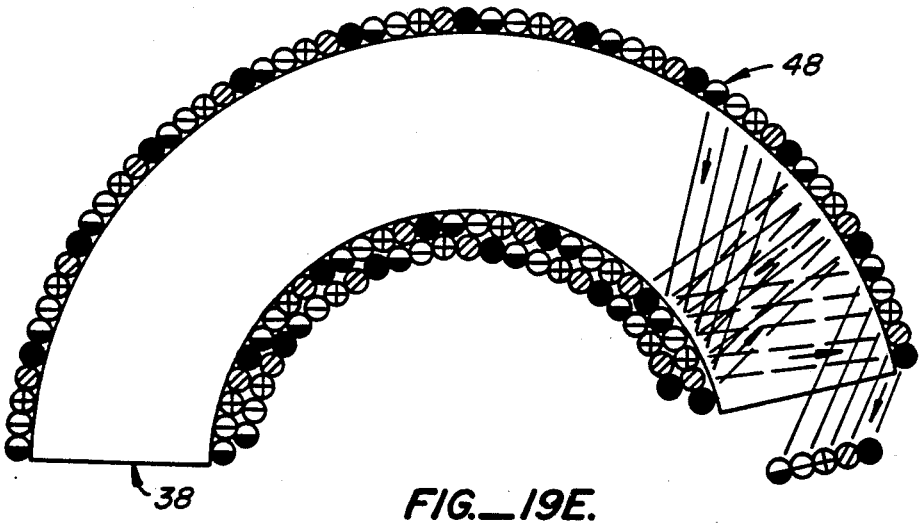

Next, as illustrated in FIG. 19B, a second type turn is wound with the multiple conductors being placed by the rotating shuttle 136 stacked upon portions of one or more first type turns at the radially inward surface of the winding mandrel 38 and side by side to the previously wound first type turns at the radially outward surface of the winding mandrel 38. It is preferable to wind at least two of the first type turns at the inward surface of the winding mandrel 38 prior to winding a second type turn thereupon to present a broad inner layer for the second type turn to stack upon. If a second type turn were to be stacked upon a single first type turn, then one or more of the strands of the second type turn would likely slip past the edge of the underlying first type turn into a position against the winding mandrel 38 which is intended to be occupied by a subsequent first type turn. The initial winding of two or more first type turns prior to commencing the winding of a second type turn and stacking the multiple conductors of the second type turn upon portions of both the previously wound first type turns eliminates this problem.

After the second type turn is wound onto the winding mandrel 38 stacked upon the previously wound first type turns at the radially inward surface of the winding mandrel 38 and side by side to the previously wound first type turns at the radially outward surface of the winding mandrel 38, the winding process continues by alternately winding first type and second type turns. Each first type turn is placed side by side to a previously wound second type turn at the radially outward surface of the winding mandrel 38, and is placed side by side to a previously wound first type turn at the radially inward surface of the winding mandrel 38. Each second type turn is stacked upon portions of one or more previously wound first type turns at the radially inward surface of the winding mandrel 38 and is placed side by side to a previously wound first type turn at the radially outward surface of the winding mandrel 38.

This process continues, as shown in FIGS. 19B–19E, until the radially outward surface of the winding mandrel 38 is substantially filled with side by side conductors and the radially inward surface of the winding mandrel 38 is substantially filled with two layers of side by side conductors to complete the inner set of windings for the low voltage winding 48. Then, as described above in relation to FIGS. 9 and 10, the outer periphery of the windings is insulated, preferably by winding a strip of insulative material about the periphery of the windings, and then the outer set of windings are wound surrounding the inner set of windings by the same single pass method.

Although the method of winding multifilar conductors in a single pass is illustrated by an example wound in the counterclockwise direction (as viewed from FIG. 16), the method can also be practiced in the clockwise winding direction by utilizing the guide wheel 152*b* on the shuttle 136 for conductor guidance and placement. In addition, although the example presented in FIGS. 19A–19E is shown with the winding operation commencing at the inward surface of the winding mandrel 38, this method can be practiced as well by commencing the winding operation at the outward surface of the winding mandrel 38. Also, the conductors 132 at the radially inward and radially outward surfaces need not be oriented axially and could be spirally oriented.

The foregoing discussion discloses and describes merely exemplary methods and embodiments of the present invention. One skilled in the art will readily recognize from such discussion that various changes, modifications and variations may be made therein without departing from the spirit and scope of the invention described in the following claims.

What is claimed is:

1. An apparatus for producing a multifilar winding having a toroidal shape, said apparatus comprising:

an arcuately shaped winding mandrel;

rotary support means for supporting and positioning said winding mandrel and operable for rotating said winding mandrel in both directions about its axis of revolution;

a magazine rotatable in both directions about a winding axis substantially orthogonal to said mandrel axis and operable for carrying a supply of wire to be wound onto said winding mandrel;

a shuttle rotatable in both directions about said winding axis and positioned coaxial to said magazine and encircling said winding mandrel;

means for rotating the magazine and the shuttle in both directions while winding wire onto the winding mandrel in both directions; and guide means coupled to said shuttle and operable for guiding the wire from said magazine to said winding mandrel;

wherein said winding mandrel includes said wire wound thereon to form the multifilar winding by rotating said magazine and shuttle in one direction about said winding axis while rotating said winding mandrel in one direction about said mandrel axis, and then rotating said magazine and shuttle in the other direction about said winding axis while rotating said winding mandrel in the other direction about said mandrel axis.

2. An apparatus as recited in claim 1 further comprising first and second pegs each positioned adjacent to one end of said winding mandrel and each operable for retaining loops and lead extensions of the wire.

3. An apparatus as recited in claim 1 wherein said winding mandrel has a semitoroidal shape.

4. An apparatus as recited in claim 1 wherein said magazine is operable for carrying two or more strands or wire, and wherein said shuttle is operable for placing said two or more strands of wire side by side onto said winding mandrel.

5. An apparatus as recited in claim 4 wherein said guide means of said shuttle includes a guide wheel rotatably coupled to said shuttle for rotation about an axis parallel to said winding axis and adapted for guiding said two or more strands of wire from said magazine to said winding mandrel.

6. An apparatus as recited in claim 5 wherein said shuttle further includes tensioning pulleys for separately applying tension forces to each of said two or more strands of wire prior to winding onto said winding mandrel.

7. An apparatus as recited in claim 1 wherein said guide means of said shuttle includes two guide wheels rotatably coupled to said shuttle for rotation about axes parallel to said winding axis and adapted for guiding wire therebetween from said magazine to said winding mandrel.

* * * * *